United States Patent [19]

Gross et al.

[11] 4,260,215

[45] Apr. 7, 1981

[54] ELECTRICAL FUSEHOLDER

[75] Inventors: Robert S. Gross; Don C. Wood, both of Fort Wayne, Ind.

[73] Assignee: General Electric Company, Fort Wayne, Ind.

[21] Appl. No.: 38,116

[22] Filed: May 11, 1979

[51] Int. Cl.[3] ..... H01R 13/12

[52] U.S. Cl. ..... 339/258 F

[58] Field of Search ..... 339/252 F, 253 F, 258 F, 339/259 F, 262 F, 125 R, 132, 134

[56] References Cited

U.S. PATENT DOCUMENTS

| | | | |
|---|---|---|---|
| 1,254,067 | 1/1918 | Platt . | |
| 1,536,149 | 5/1925 | Schmid | 339/262 F |
| 1,987,181 | 1/1935 | Condon . | |
| 2,086,727 | 7/1937 | Morris . | |
| 2,200,917 | 5/1940 | Dodge | 339/262 F |
| 2,777,916 | 1/1957 | Cooper . | |
| 3,001,173 | 9/1961 | Swengel . | |

FOREIGN PATENT DOCUMENTS

| | | | |
|---|---|---|---|
| 464,498 | 2/1972 | Japan | 339/125 R |

*Primary Examiner*—Joseph H. McGlynn

*Attorney, Agent, or Firm*—James H. Beusse; Arthur E. Bahr

[57] ABSTRACT

An electrical fuseholder for receiving an elongated, cylindrical fuse is provided with a pair of sheet-metal terminals which serve as means for connection into a circuit to be protected, as well as mechanical mounting means. The terminals are secured respectively between a pair of U-shaped fuseholder clips and an electrically insulating base and are provided with flanges for prevention of rotation of the respective terminals relative to the insulating base and of the U-shaped clips relative to the respective terminals.

1 Claim, 3 Drawing Figures

ELECTRICAL FUSEHOLDER

BACKGROUND OF THE INVENTION

1. Field of the Invention

The present invention relates to an improved fuseholder for receiving an elongated, cylindrical type fuse, and more particularly, to such a fuseholder including sheet metal terminals for mechanical and electrical connection to a transformer or the like.

2. Description of the Prior Art

Electrical fuseholders of the type for receiving elongated, cylindrical fuses and particularly those of the minifuse type, generally are provided as an assembly which includes an electrically insulating base member, this base member providing both spacing to the fuse-clips and a means for mounting the assembly in the environment where it will be used. Such electrical fuseholders generally are provided with a pair of terminals including a pair of screws, the terminals being suitably electrically connected to the fuse-clips, the screws providing means for connection into the electrical circuit to be protected.

It is often desirable, however, that such an electrical fuseholder have means for mechanical mounting thereof as a part of the electrical terminal structure.

It is an object of the present invention to provide an electrical fuseholder wherein the electrical terminals thereof double as means for mechanically mounting the fuseholder to the device to be protected.

SUMMARY OF THE INVENTION

In accordance with the present invention, there is provided an electrical fuseholder for receiving an elongated cylindrical fuse. The fuseholder comprises an elongated, electrically insulating strip forming a base and first and second electrically conducting U-shaped clips secured to the base at opposite ends thereof, respectively. First and second electrically conducting sheet metal terminals are provided, the terminals being securedly disposed, respectively, between the first and second U-shaped clips and the insulating board. The terminals are arranged generally parallel to each other and extending in the same direction, transverse to the insulating strip. Each terminal includes a downturned flange communicating with the respective end of the insulating strip for preventing rotation of the terminal relative to the strip. Each terminal further includes an upturned flange communicating with the respective U-shaped clip for preventing rotation of the clip relative to the terminal.

DESCRIPTION OF THE PREFERRED EMBODIMENT

Figure 1:
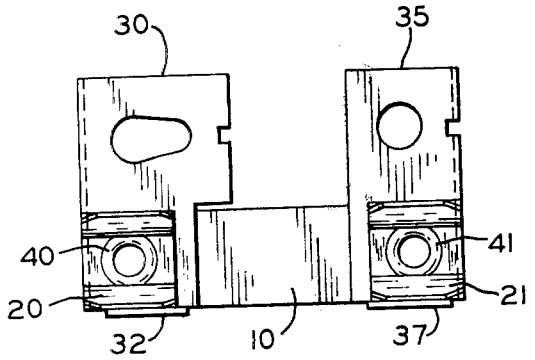
FIG. 1 is a plan view of the preferred embodiment of the electrical fuseholder of the present invention.
Figure 2:
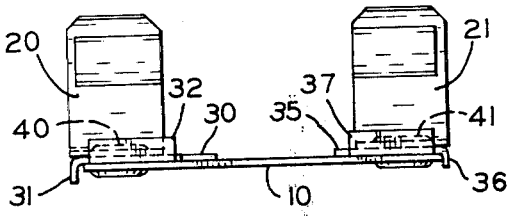
FIG. 2 is a front elevation of the fuseholder.
Figure 3:
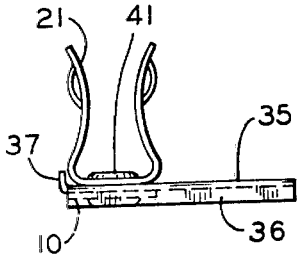
FIG. 3 is a side elevation of the fuseholder.

In accordance with the present invention and referring generally now to FIGS. 1, 2, and 3, there is shown the preferred embodiment of an improved electrical fuseholder for receiving an elongated, cylindrical fuse. An elongated, electrically insulating strip 10 forms a base for the assembly. First and second electrically conducting U-shaped clips 20 and 21 are provided for receiving such a fuse. First and second electrically conducting sheet metal terminals 30 and 35 are located between the U-shaped clips 20 and 21, respectively, and insulating base 10. Means are provided for securing the U-shaped clips to the insulating strip, and these may take the form of a pair of eyelets 40 and 41. Of course, eyelets 40 and 41 also serve to secure terminals 30 and 35, respectively, to the base 10.

As can be seen in the drawing, terminals 30 and 35 are generally parallel to each other and extend in the same direction, that being transverse to the long dimension of the insulating base strip 10. Terminal 30 is provided with a downturned flange 31 and terminal 35 is provided likewise with a downturned flange 36, flanges 31 and 36 serving to locate the respective flanges relative to the base 10 and to prevent rotation of the components relative to each other. Terminal 30 is also provided with an upturned flange 32 and terminal 35 is provided with an upturned flange 37, these flanges communicating respectively with the U-shaped clips 20 and 21 thereby serving to prevent rotation of the clips relative to the respective terminals.

As can be seen, the provision of flanges 31 and 32 on terminal 30 and flanges 36 and 37 on terminal 35 serve to provide a fuseholder assembly, all of whose components stay in their assigned positions relative to each other. This results in a simple but fairly rigid assembly whereby the U-shaped clips stay in the proper position relative to each other for receiving such a fuse.

Apertures are also provided in the respective terminals, these apertures serving both as a mechanical mounting means and means for electrically connecting the fuseholder into the circuit to be protected. As can be seen, terminal 35 is provided with a generally round aperture while terminal 30 is provided with an elongated aperture. Such an arrangement provides for using the same fuseholder in a multiplicity of arrangements whereby the mounting means, the electrical terminals to which they are secured, may vary in spacing.

It should be noted that the electrical fuseholder described herein is not limited to exclusive use in a transformer circuit, but could be readily applied in any environment where it is desirable to provide a fuseholder wherein the electrical terminals thereof double as mechanical mounting means.

It should be apparent to those skilled in the art that the embodiment described heretofore is considered to be the presently preferred form of the invention. In accordance with the patent statutes, changes may be made in the disclosed device and the manner in which it is used without actually departing from the true spirit and scope of the invention.

What is claimed is:

1. A fuseholder comprising:

an elongated, electrically insulating strip forming a base;

first and second electrically conducting U-shaped clips for receiving an elongated cylindrical fuse;

means for securing the U-shaped clips to opposite ends respectively of the insulating strip; and, first and second electrically conducting sheet metal terminals, said first and second terminals being securely disposed, respectively, between the first and second U-shaped clips and the insulating board, the terminals extending in a direction transverse to the insulating strip, each terminal having a downturned flanged contacting the respective end of the insulating strip for preventing rotation of the terminal relative to the strip, each terminal further having an upturned flange contacting the respective U-shaped clip for preventing rotation of the clip relative to the terminal, each of said terminals being provided with apertures in the ends thereof opposite the U-shaped clips for effecting mechanical mounting of the fuseholder and electrical connection of the terminals to electrical terminals in a circuit to be protected, at least one of the apertures in one of said terminals being elongated in a direction parallel with the insulating strip.

* * * * *